US006199724B1

(12) United States Patent
Yeranossian

(10) Patent No.: US 6,199,724 B1
(45) Date of Patent: Mar. 13, 2001

(54) BULK PRE-MEASURED SINGLE HAND DISPENSER

(75) Inventor: Karl Yeranossian, Pearl River, NY (US)

(73) Assignee: P.O.P. Displays, Inc., Woodside, NY (US)

( * ) Notice: Subject to any disclaimer, the term of this patent is extended or adjusted under 35 U.S.C. 154(b) by 0 days.

(21) Appl. No.: 09/036,917

(22) Filed: Mar. 9, 1998

Related U.S. Application Data

(60) Provisional application No. 60/040,927, filed on Mar. 17, 1997.

(51) Int. Cl.[7] ..... B67D 5/38

(52) U.S. Cl. ..... 222/154; 222/185.1; 222/453; 141/317

(58) Field of Search ..... 222/154, 185.1, 222/444, 453; 141/317

(56) References Cited

U.S. PATENT DOCUMENTS 4,718,578 * 1/1988 Radek et al. ..... 222/154
5,823,393 * 10/1998 Hafstrom ..... 222/154

FOREIGN PATENT DOCUMENTS

1190390 * 1/1965 (DE) ..... 222/444
2204298 * 11/1988 (GB) ..... 222/154

* cited by examiner

*Primary Examiner*—Philippe Derakshani
(74) *Attorney, Agent, or Firm*—Nolte, Nolte & Hunter; Christopher B. Garvey

(57) ABSTRACT

A store display, for one handed dispensing a measured volume of bulk items such as hard candy, has a storage compartment. The storage compartment has a sloping floor for gravity feeding a dispenser. A chute, attached to the separator and moveable with it, prevents dispensing in a low position, in which low position a separator allows bulk items to flow towards the chute. One hand holding a bag drives the assembly of chute and separator up to where the separator separates the measured volume of bulk items, and the chute communicates between the measured volume and an exit. The chute thereby permits the measured volume of bulk items to flow out the exit, and into the bag.

8 Claims, 4 Drawing Sheets

BULK PRE-MEASURED SINGLE HAND DISPENSER

This application claims the benefit of U.S. Provisional Application Ser. No. 60/040,927 filed May 17, 1997.

The present invention relates to a dispenser for the dispensing of bulk items. It is particularly suited to the dispensing of bulk foods. It is more particularly suited to the dispensing of bulk candy. It is very well suited to the bulk dispensing of M&M™ candies.

BACKGROUND OF THE INVENTION

Various devices have been advised to dispense quantities of bulk items, such as candy in retail environments. Perhaps the simplest is a scoop of a predetermined size, with which a customer can scoop the bulk items out of a barrel.

However, modern considerations of sanitation and tamper-resistance dictate that such foods be secure from handling by the customer except as to the amounts being dispensed at the time.

OBJECTS

It is an object of this invention to provide convenient dispensing of bulk food; dispensing that avoids customer hand contact with any of the food. Another object of such a dispenser is that is dispense a pre-measured quantity in a fairly accurate amount.

Another object of the invention is that a customer be able to use one hand to place a bag in a receiving relationship to the dispenser, and with that same hand actuate the dispensing of the bulk item into said bag, without hand contact with the item. The present invention achieves all of these objects in a secure and reliable and asthetically pleasing dispenser.

DETAILED DESCRIPTION OF THE DRAWINGS

Figure 1:
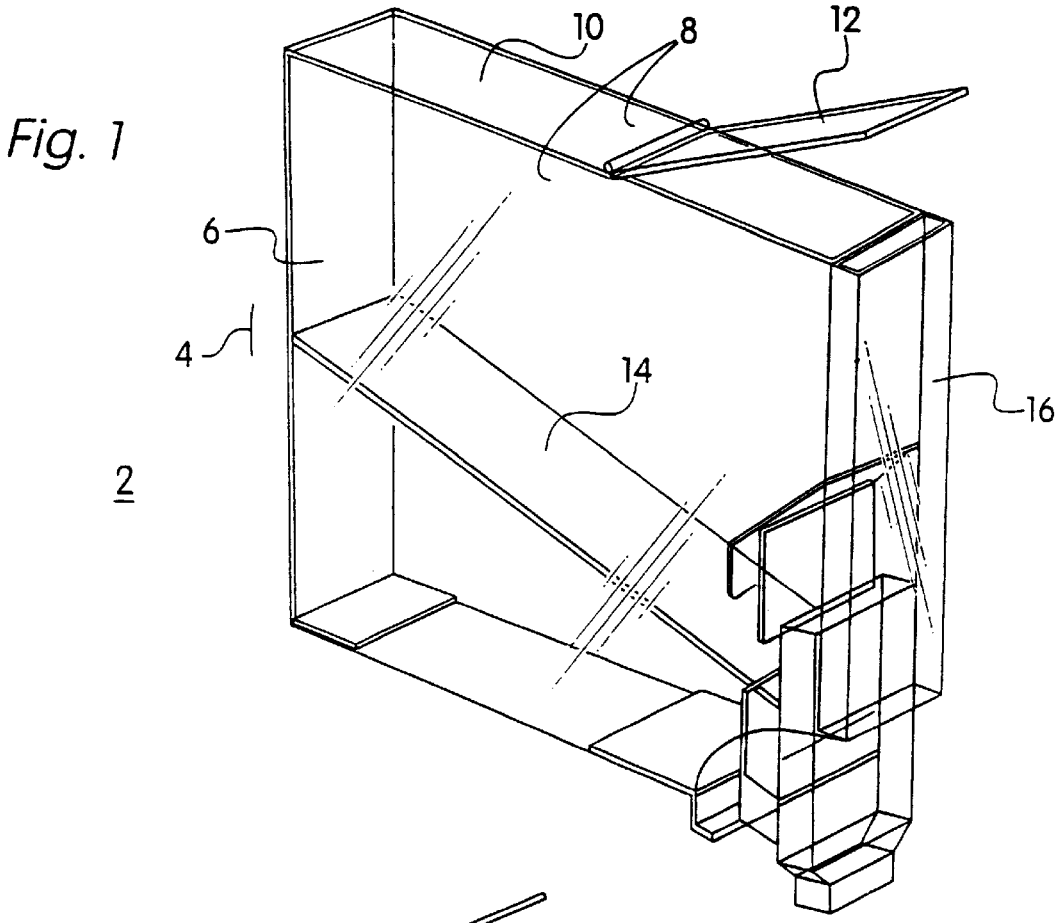
FIG. 1 is an oblique view of the dispenser of the present invention.
Figure 2:
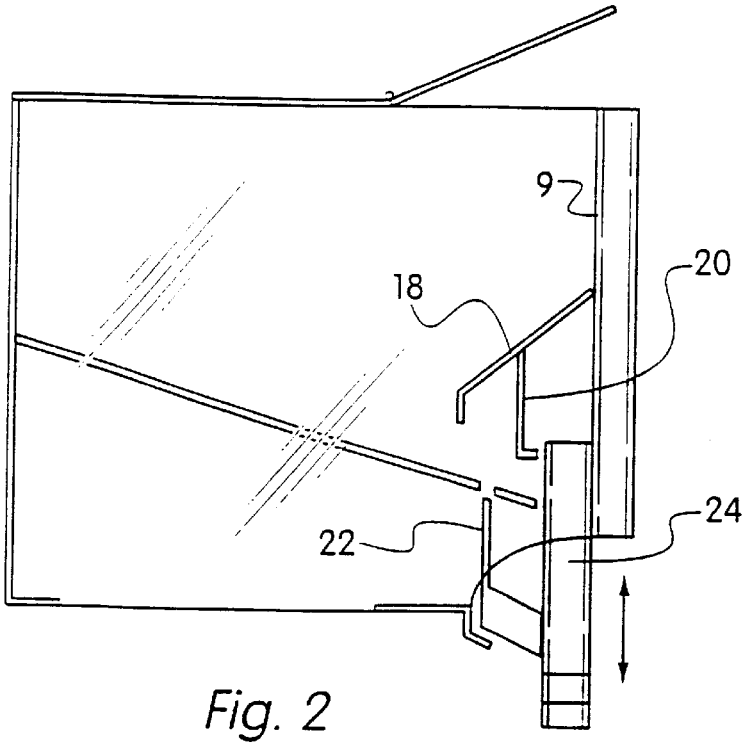
FIG. 2 is a side elevation thereof.

As shown in FIG. 1, the bulk candy pre-measured single-hand dispenser, generally designated 2, comprises a housing 4, comprising rear walls 6, side walls 8, front wall 9, top 10, hinged top lid 12, and ramped floor 14. Walls 6, 8, and front wall 9, floor 14, and top 10 define a storage compartment 15.

In practice on the shelves on a supermarket, hinged top 12 will snugly placed below the next shelf thereabove, thus, requiring a customer to pull the entire apparatus out before he can access the top lid for loading purposes. This will deter most store customers from accessing the bulk material in an unintended manner.

Alternatively, secure locking means can be fitted to the hinged top lip.

A factice display front 16, comprises a hollow transparent rectilinear box, which is intended to be filled with the candy, such as M&M's, to provide an attractive and colorful display. The display front occupies almost the entire front of the unit and does not deplete as the level of candy in housing 4 diminishes, thereby providing a more informative, bountiful and asthetically pleasing display.

Dispenser ceiling 18, protects the dispenser area from bearing the weight of the bulk candy, which would otherwise rest, in a full housing, on the dispenser. A chute guide wall 20 depends from ceiling 18. It has been found that the full weight of bulk candy resting on the dispenser area would interfere with the operation of the dispenser separator 22, which is attached to dispenser chute 24, and moves up with the chute when a single hand pushes the chute.

Chute guide wall 20 guides dispenser chute 24 and helps define the measuring chamber volume.

Figure 3:
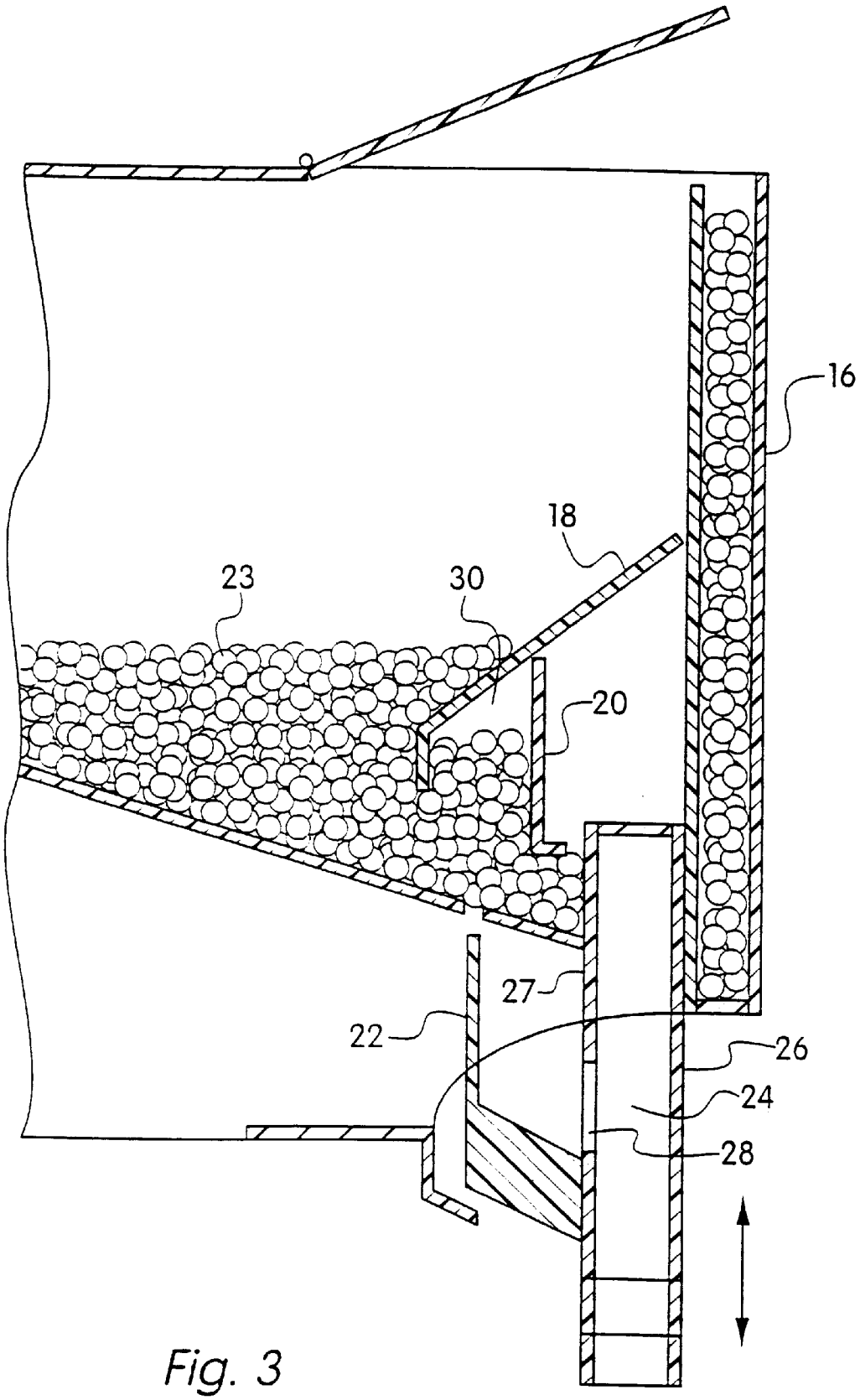
FIG. 3 is a side elevation detail of the dispensing apparatus.

As shown in FIG. 3, chute 24 comprises a front wall 26, a back wall 27, and an opening 28 in back wall 27. Gravity forces M&M's 23 into measuring chamber 30, which consistently fills to a reproducible level, as in FIG. 3.

Figure 4:
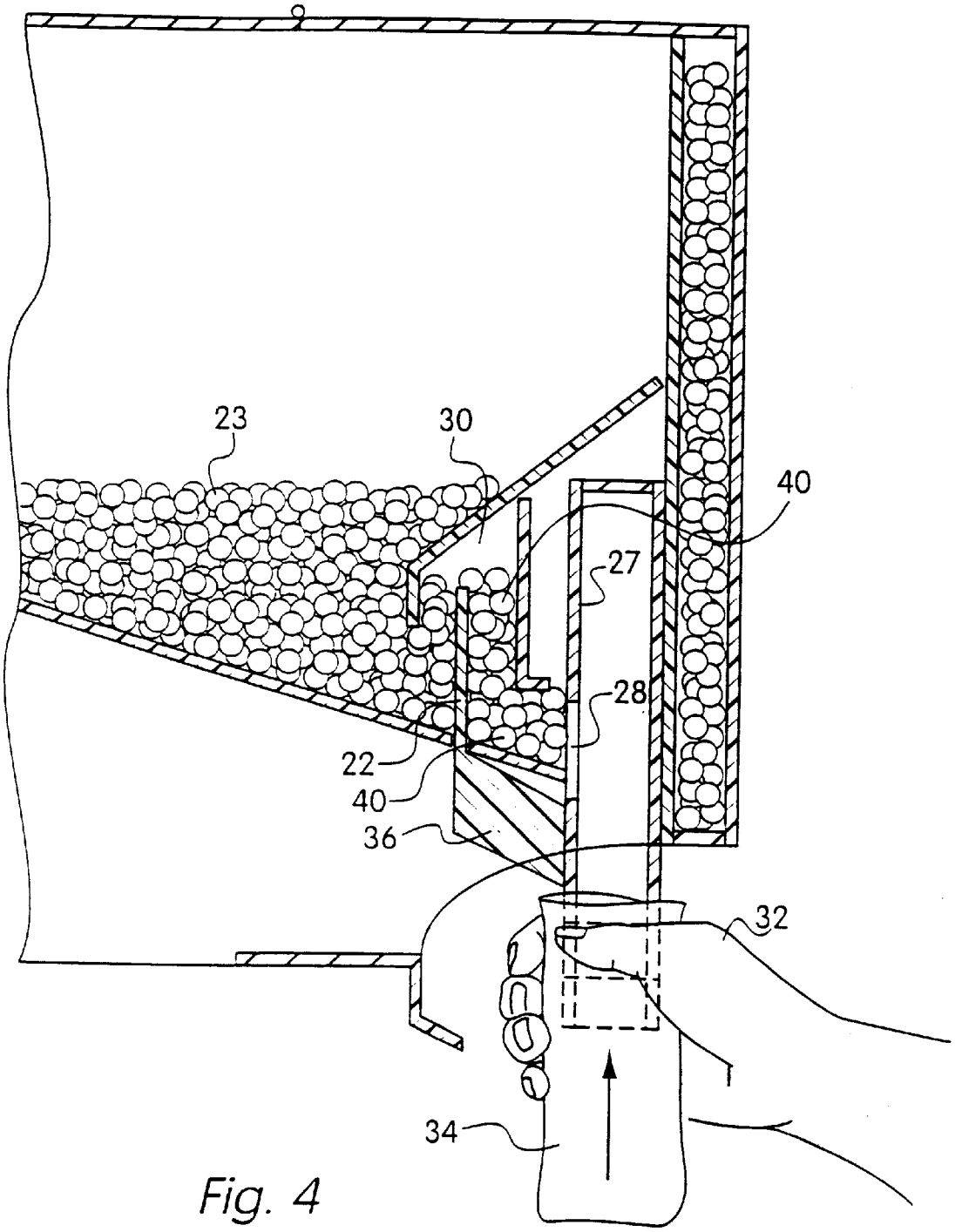
FIGS. 4 and 5 are side elevations of the dispensing apparatus in an alternative position.
Figure 5:
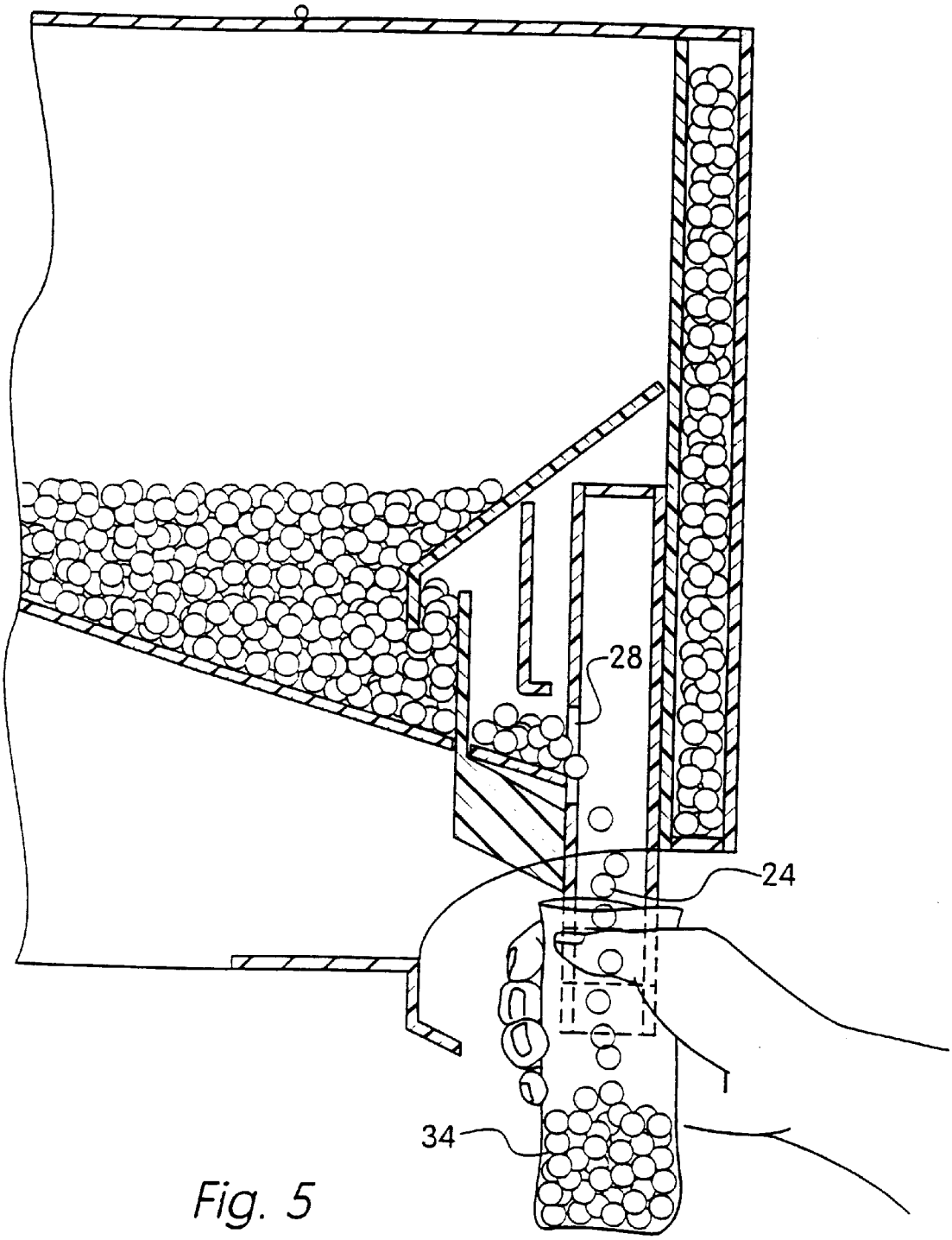

As shown in FIG. 4, when hand 32 forces a receptacle such as bag 34 against the mount 36 of separator 22, hand 32 drives separator 22 through chamber 30, separating M&M's 23 from M&M's 40 in chamber 30. This also drives chute 24 upward, which locates opening 28 in back wall 27, adjacent chamber 30, allowing M&M's 40 therein to pass through opening 28 as shown in FIG. 5, and fall through chute 24, out exit 41 into bag 34. The candy can fall into the bag without touching the customer's hand.

Since the chambered M&M's 40 vary in quantity insignificantly from previous and subsequent chambered amounts, the measuring of each portion is fairly accurate. When hand 32 and bag 34 are again withdrawn, gravity allows chute 24 to fall and separator 22 to withdraw from chamber 30, causing a new charge of pre-measured candy to refill chamber 30.

If a supermarket display shelf area has a plurality of these dispensers, and each dispenser has a single color of a candy such as M&M's, which comes in a variety of colors, customers can choose all of one color, or choose to mix their preferred M&M's according to color combination, preference, season, school colors, color theme or any other whimsical purpose.

I claim:

1. An apparatus for dispensing a measured volume of bulk items, said apparatus comprising:

a housing;

said housing comprising:

a storage compartment as means for storing the bulk items, and a means for dispensing the bulk items;

said storage compartment comprising a sloping floor means for gravity feeding the dispensing means;

said dispensing means comprising:

moveable means for separating the measured volume from the storage compartment;

chute means, attached to the separator means and moveable therewith, said chute means:

for preventing dispensing in a first position, in which first position the separator means allows bulk items to flow towards the chute means;

in a second position, in which second position the separator means separates, said chute means for communicating between the measured volume and an exit; and said chute means for thereby permitting the measured volume to flow out the exit.

2. Apparatus according to claim 1 further comprising ceiling means for protecting the separator means from a pressure generated by the bulk items which are located above the separator means, said ceiling means located above the separator means.

3. Apparatus according to claim 1 in which the sloping floor means comprises a slot means for deploying the separator means.

4. Apparatus according to claim 1 in which the chute means is further for one handed dispensing of the bulk item into a receptacle.

5. Apparatus according to claim 1 further comprising:

ceiling means for protecting the separator means from a pressure generated by the bulk items which are located above the separator means, said ceiling means located above the separator means;

in which the sloping floor means comprises a slot means for deploying the separator means;

in which the chute means is further for one handed dispensing of the bulk item into a receptacle.

6. Apparatus according to claim 5 in which:

the housing further comprises a front wall;

said front wall having, mounted thereon, a factice front compartment means for always displaying a full surface of bulk item.

7. Apparatus according to claim 6 in which the measured volume is defined by:

the sloping floor;

a chute guide wall depending from the ceiling;

a chute back wall;

a pair of side walls;

the separator means; and at least in part by the ceiling.

8. A method of single-handedly dispensing a measured volume of bulk item, said method comprising the steps of:

loading the bulk item into a storage compartment;

said storage compartment communicating via a sloping floor with a measured volume and thereby gravity loading the bulk item into the measured volume;

said measured volume defined in part by a back wall of a dispensing chute;

said back wall comprising an opening normally located below the sloping floor;

single-handedly placing a receptacle adjacent and below an exit of the chute;

single-handedly driving the chute upward and thereby:

driving a separator through the bulk item to fully define the measured volume;

exposing the opening to the bulk item, thereby permitting the measured volume of the bulk item to flow
down the sloping floor,
through the opening,
through the chute,
out the exit, and
into the receptacle.

* * * * *